US012577766B2

(12) United States Patent
Städtler et al.

(10) Patent No.: US 12,577,766 B2
(45) **Date of Patent: *Mar. 17, 2026**

(54) OUTLET ELEMENT FOR A SANITARY FITTING

(71) Applicant: Neoperl GmbH, Müllheim (DE)

(72) Inventors: Georg Städtler, Müllheim (DE); Alexander Bayer, Schliengen (DE)

(73) Assignee: NEOPERL GMBH, Muellheim (DE)

( * ) Notice: Subject to any disclaimer, the term of this patent is extended or adjusted under 35 U.S.C. 154(b) by 305 days.

This patent is subject to a terminal disclaimer.

(21) Appl. No.: 18/037,805

(22) PCT Filed: Nov. 19, 2021

(86) PCT No.: PCT/EP2021/082242

§ 371 (c)(1),
(2) Date: May 19, 2023

(87) PCT Pub. No.: WO2022/106590

PCT Pub. Date: May 27, 2022

(65) Prior Publication Data

US 2024/0011267 A1 Jan. 11, 2024

(30) Foreign Application Priority Data

Nov. 19, 2020 (DE) ..... 202020106636.6

(51) Int. Cl.
*E03C 1/02* (2006.01)
*E03C 1/08* (2006.01)

(52) U.S. Cl.
CPC ..... *E03C 1/08* (2013.01); *E03C 2001/026* (2013.01)

(58) Field of Classification Search
CPC ..... E03C 1/0404; E03C 1/086; E03C 1/08; E03C 2001/026; E03C 1/084; E03C 1/02;
(Continued)

(56) References Cited

U.S. PATENT DOCUMENTS 5,348,231 A 9/1994 Arnold et al.
6,135,154 A 10/2000 Chen et al.
(Continued)

FOREIGN PATENT DOCUMENTS

CN 110159797 * 8/2019 ..... E03C 1/08
DE 1017543 10/1957
(Continued)

*Primary Examiner* — Christopher R Dandridge
(74) *Attorney, Agent, or Firm* — Volpe Koenig

(57) ABSTRACT

An outlet element (1) for a sanitary fitting which includes a base element (2) and a valve device (3) which is connected to the base element and can be adjusted relative to the base element between at least two switching positions for switching over between at least two separate water conduits (4, 5). In order to seal a passage between an outlet opening (6) of the base element on the outflow side and at least one inlet opening (7, 8) of a connected water conduit on the inflow side, the base element has a sealing element (9) which in each of the at least two switching positions is designed to seal the relevant passage between an outlet opening of the base element on the outflow side and the at least one inlet opening of the connected water conduit on the inflow side.

17 Claims, 12 Drawing Sheets

(58) Field of Classification Search
CPC ..... B05B 17/0653; B05B 17/0676; B05B 17/0638; B05B 7/0408; B05B 1/1636; B05B 7/0425
See application file for complete search history.

(56) References Cited

U.S. PATENT DOCUMENTS

2009/0288250 A1 11/2009 Zhou
2016/0168829 A1* 6/2016 Chen ..... F16K 11/056 137/625.41

FOREIGN PATENT DOCUMENTS

DE 202011050534 1/2012
DE 102011083447 3/2012

* cited by examiner

OUTLET ELEMENT FOR A SANITARY FITTING

CROSS-REFERENCE TO RELATED APPLICATIONS

This application is a 371 National Phase of International Application No. PCT/EP2021/082242, filed Nov. 19, 2021, which claims priority to German Patent Application No. 20 2020 106 636.6, filed Nov. 19, 2020, both of which are incorporated herein by reference as if fully set forth.

TECHNICAL FIELD

The invention relates to an outlet element for a sanitary fitting which comprises a base element, which is designed to be connected to an outlet, and which comprises a valve device which cooperates with the base element and which can be adjusted, in particular can be rotated, relative to the base element between at least two switching positions for switching over between at least two separate water conduits, wherein the base element has at least one outlet opening on the outflow side and in each case at least one inlet opening of the valve device on the inflow side is assigned to each water conduit.

BACKGROUND

Such outlet elements are already known from practice in very different embodiments.

SUMMARY

It is the object of the invention to provide an outlet element of the type mentioned in the introduction which permits efficient sealing of the at least two water conduits between the base element and the valve device.

To achieve this object, an outlet element is proposed having the means and features of the independent claim relating to an outlet element. In order to achieve the object, in particular, it is thus proposed in an outlet element of the type mentioned in the introduction that the base element has a sealing element, in each of the at least two switching positions a passage being able to be sealed thereby between the at least one outlet opening of the base element on the outflow side and the at least one inlet opening of the switched water conduit on the inflow side. In this manner, the at least two separately switchable water conduits of the outlet element can be separated from one another by means of only one sealing element and the passage between the base element and the valve device, through which the respectively switched water conduit runs, can be sealed relative to the base element in each of the at least two switching positions of the valve device.

In one embodiment of the outlet element, the base element has a seal receiver in which the sealing element is arranged. In this manner, it is possible to fix the sealing element in a reliable manner to the base element when the base element and the valve device are adjusted relative to one another for switching over between the at least two switching positions. Due to the relative adjustment of the valve device and the base element to one another, the sealing element which is positioned in the seal receiver can also be moved into different sealing positions assigned to the respective switching positions.

The seal receiver can comprise or be, for example, a receiving groove which is configured in the base element and in which the sealing element can be positively fixed, for example, regarding relative movements between the valve device and the base element.

In one embodiment of the outlet element, it is provided that a seal receiver, for example the seal receiver which has already been mentioned above, and/or the sealing element can be arranged and/or configured such that, in particular, in each of the at least two switching positions projections of the inlet openings at right-angles to the base element are located inside an outer edge of the seal receiver, in particular of the sealing element and/or inside a cross section of the base element defined by the seal receiver. In this manner, it is ensured that in each of the at least two switching positions of the valve devices at least one inlet opening on the inflow side of the at least two water conduits, which are separate from one another, are arranged relative to the sealing element such that a sealed water conduit is produced by the base element, the at least one outlet opening thereof on the outflow side and the at least one inlet opening of the valve device on the inflow side, which in the respective switching position is moved into a throughflow position.

The seal receiver can be configured, for example, on an outflow side of the base element. Moreover, it is possible that inlet openings of at least two of the water conduits differ from one another regarding shape and/or size.

In one embodiment of the outlet element, it is provided that the at least one outlet opening of the base element and the at least one inlet opening of one of the at least two water conduits of the valve device have the same cross section.

At this point it should be mentioned that in an embodiment of the outlet element, two outlet openings can be provided on the base element on the outflow side, the outlet openings preferably have a coinciding opening cross section. Matching the at least two outlet openings of the base element with a coinciding opening cross section, the valve device can also have in each case two inlet openings on the inflow side for each of the at least two switching positions thereof. The inlet openings of the valve devices on the inflow side, which are assigned to a water conduit, can have coinciding opening cross sections.

In one embodiment of the outlet element, it is provided that the seal receiver for the sealing element is endless.

The seal receiver can be, for example, an endless receiving groove.

In one embodiment of the outlet element, the base element can have a threaded pipe connector on its inflow side. In this manner, the base element can be screwed to a corresponding mating thread, for example of a further element of the outlet element, and/or a sanitary fitting.

Moreover, the base element can have on its outflow side an extension via which the valve device can be connected or is connected to the base element. By means of the extension, the base element and the valve device can be connected together to form a unit. In this context it can be advantageous if the valve device on its inflow side has a corresponding plug receiver for the extension of the base element.

At this point it should be mentioned that the reverse arrangement of the extension and the plug receiver is also conceivable. Thus in one embodiment of the outlet element the valve device can have an extension on its inflow side for connecting to the base element. Accordingly, the base element can then have a plug receiver for the extension of the valve device.

The aforementioned extensions can be configured in an annular manner. Moreover, it is possible that the extension of the base element is integrally formed on the base element. It is also possible that the valve device has an extension which is annular and/or is integrally formed on the valve device. The element which has no extension, i.e. either the valve device or the base element, can then be plugged or is plugged onto the extension for the purpose of connecting the valve device to the base element.

The outlet element can have an actuating element, the valve device being able to be adjusted thereby relative to the base element. Preferably, the valve device can be rotated relative to the base element by means of the actuating element of the outlet element in order to switch the valve device and the base element relative to one another between the at least two switching positions of the at least two water conduits which are separate from one another.

The valve device and/or at least one part of the base element, in particular an extension, for example the extension already mentioned above, of the base element, can be arranged at least partially inside a receiving space defined by the actuating element. To this end, the actuating element can be configured as an actuating sleeve which receives therein at least one part of the base element and/or the valve device. In one embodiment of the actuating element, it has an actuating wing which can protrude, for example, in particular radially outwardly from a base body of the actuating element in order to be easily accessible for a user of the outlet element.

The actuating element can be designed to actuate the valve device such that one of the at least two separate water conduits is switched on and remains switched on until the user switches back to the other water conduit.

In one embodiment of the outlet element it is provided that the base element has at least two outlet openings on the outflow side. In this context it is possible that each water conduit has in each case a corresponding number of inlet openings on the inflow side.

When the water conduit is switched, projections of the inlet openings of the switched water conduit on the inflow side at right-angles to the base element can be located inside the outlet openings of the base element.

The sealing element can have a number of through-openings which are separated from one another, the number corresponding to a number of outlet openings of the base element on the outflow side. In a preferred embodiment, the base element has two through-openings on the outflow side. Accordingly, the sealing element then has two through-openings which are separated from one another and in each case one thereof is assigned to one of the two outlet openings of the base element on the outflow side. The sealing element can be configured in the shape of an hour glass or figure of eight. For example, this shape can be formed by a constriction of the sealing element between two through-openings.

The through-openings of the sealing element and the outlet openings of the base element on the outflow side can have in each case corresponding geometries in pairs. In this manner, it is possible to seal in a reliable manner the outlet openings of the base element on the outflow side by means of the sealing element.

BRIEF DESCRIPTION OF THE DRAWINGS

The invention is described in more detail hereinafter with reference to exemplary embodiments but is not limited to the exemplary embodiments shown. Further exemplary embodiments are found by combining the features of individual claims or a plurality of claims with one another and/or by combining individual features or a plurality of features of the exemplary embodiments.

In the drawings:

FIG. 20 shows a view of the outlet element shown in FIG. 19 cut along the cutting line denoted by XX-XX in FIG. 19, FIGS. 21 and 22 show views on the inflow side of the outlet element shown in the previous Figures with inlet openings of the valve device on the inflow side shown in dashed-dotted lines and also the sealing element shown in dashed-dotted lines, wherein

DETAILED DESCRIPTION

Figure 1:
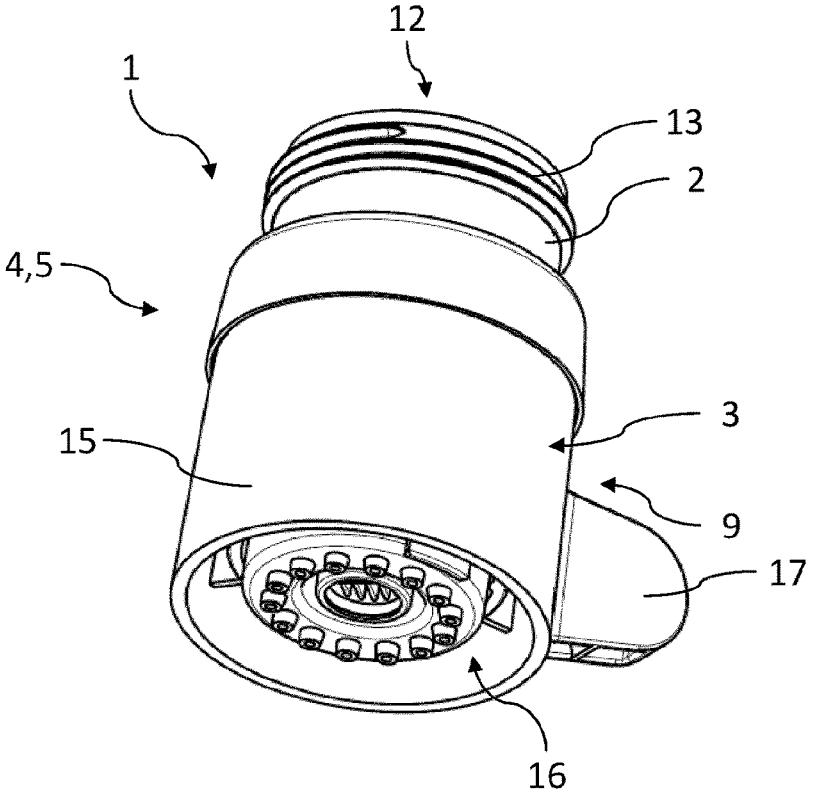
FIG. 1 shows a perspective view of an outlet element.
Figure 2:
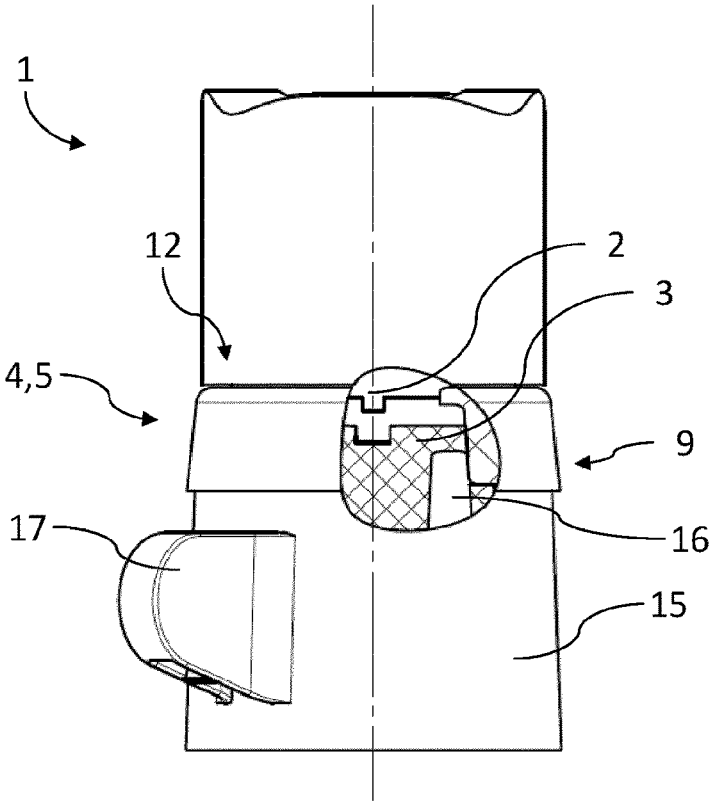
FIG. 2 shows a partially broken side view of the outlet element shown in FIG. 1.

In the following description of different embodiments of the invention, elements which coincide in terms of their function are also provided with corresponding reference signs, even in the case of a different design or shape.

All of the figures show at least parts of an outlet element denoted by 1 as a whole. The outlet elements 1 are suitable for use in or on a sanitary fitting. Each outlet element 1 has a base element 2 which is designed for connecting to an outlet of the sanitary fitting. Moreover, each outlet element 1 comprises a valve device 3 which cooperates with the base element 2 and which can be adjusted, in the specific exemplary embodiments of the outlet element 1 can be rotated, relative to the base element 2 between at least two switching positions for switching over between at least two separate water conduits 4 and 5.

Each base element 2 has at least one outlet opening 6 on the outflow side. In the specifically shown embodiments of the outlet element 1, two outlet openings 6 are provided and in each case two inlet openings 7 and 8 of the valve device 3 on the inflow side are assigned to each water conduit 4 and 5.

The figures show that the base element 2 has two outlet openings 6 on the outflow side. Accordingly, each of the two water conduits 4 and 5 also has in each case a corresponding number of inlet openings 7 and 8 on the inflow side, namely in each case two inlet openings 7 or 8 on the inflow side in the exemplary embodiment shown.

In all of the outlet elements 1 shown, it is provided that the respective base element 2 has a sealing element 9, a passage between the two outlet openings 6 of the base element 2 on the outflow side and the two inlet openings 7 or 8 of the respectively switched water conduit 4 or 5 on the inflow side being able to be sealed thereby, in each of the at least two switching positions.

The figures show that the respective base element 2 has a seal receiver 10 in which the sealing element 9 is arranged. It is clear by way of FIGS. 21 and 22, for example, that the seal receiver 10 and the sealing element 9 are arranged and configured such that in each of the at least two switching positions projections of two of the inlet openings 7 and 8 at right-angles to the base element 2 are located inside an outer edge of the seal receiver 10 and also of the sealing element 9 and additionally inside a cross section of the base element 2 defined by the seal receiver 10.

Figure 21:
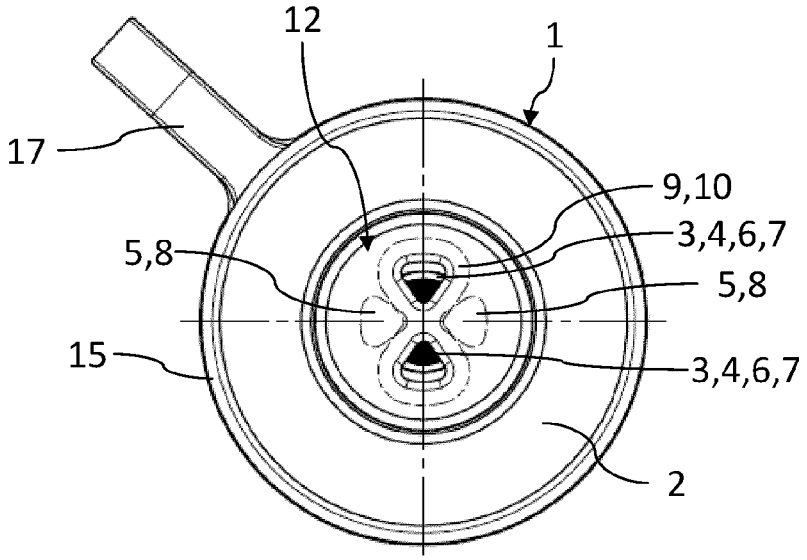
FIG. 21 shows the valve device in a first switching position and FIG. 22 shows the valve device in a second switching position.
Figure 22:
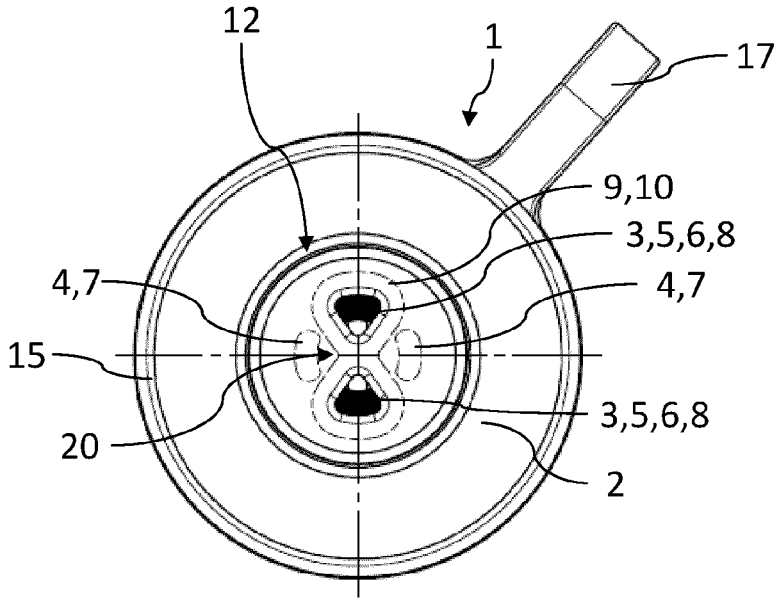
Figure 23:
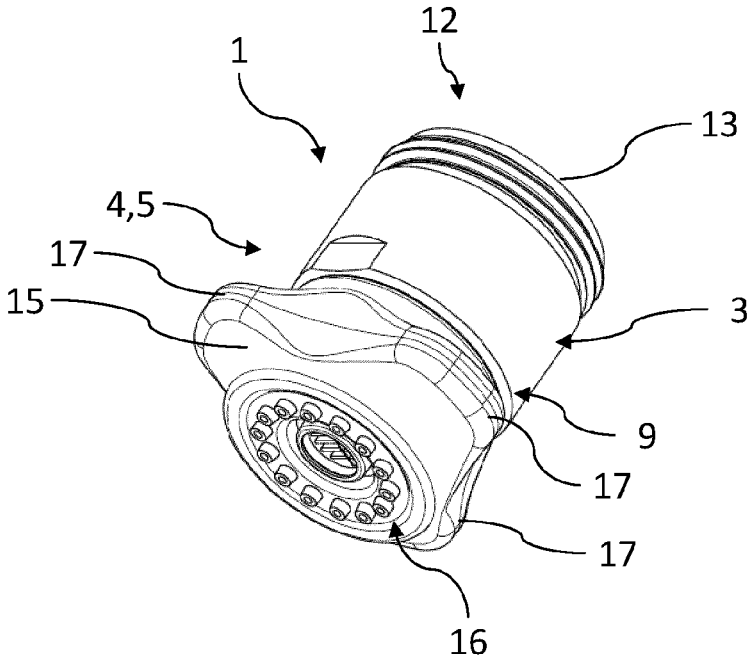
FIG. 23 shows a perspective view of a further outlet element with a differently designed actuating sleeve for actuating the valve device of the outlet element.
Figure 24:
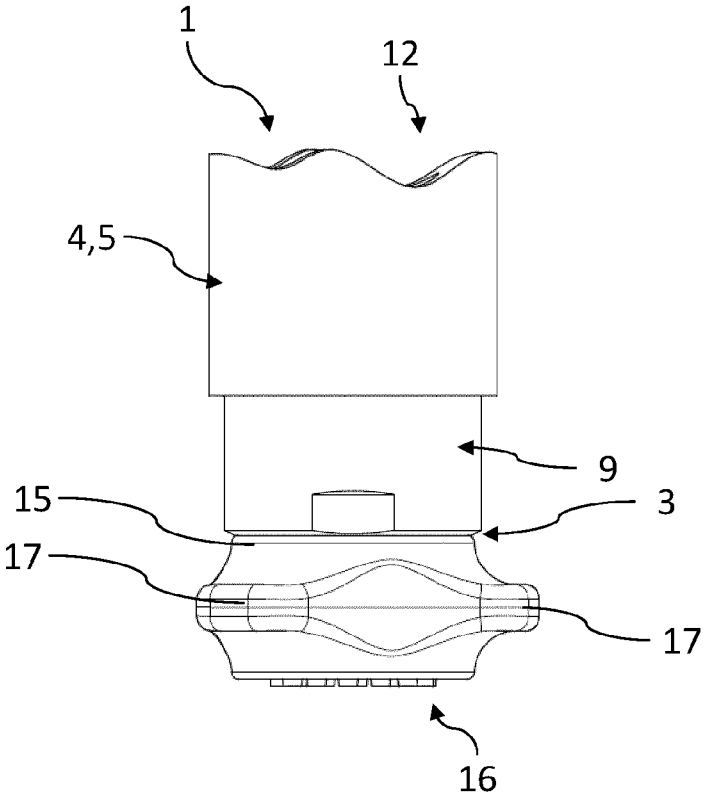
FIG. 24 shows a side view of the outlet element shown in FIG. 23.
Figure 25:
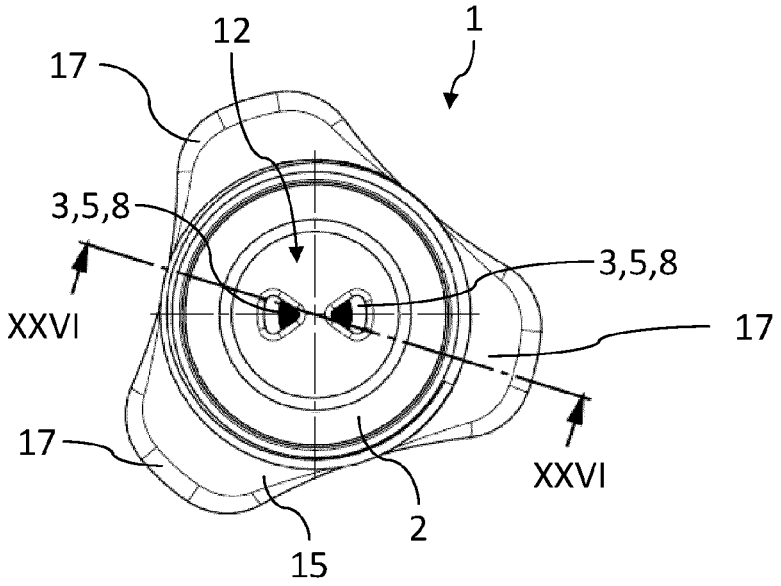
FIG. 25 shows a plan view of an inflow side of the outlet element shown in FIGS. 23 and 24.
Figure 26:
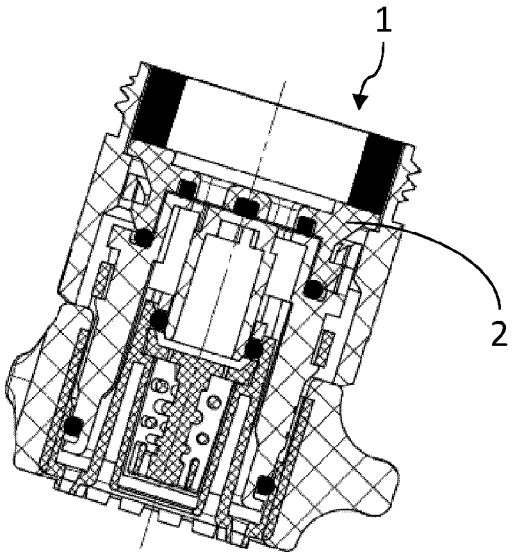
FIG. 26 shows a side view of the outlet element shown in FIGS. 23-25 in a first switching position cut along the line marked by XXVI-XXVI in FIG. 25.
Figure 27:
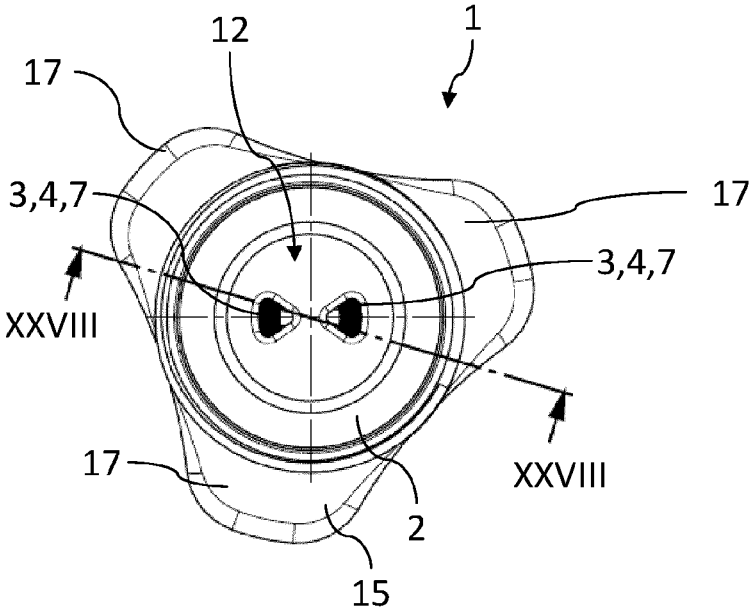
FIG. 27 shows a plan view of an inflow side of the outlet element shown in FIGS. 23-26 in a second switching position.
Figure 28:
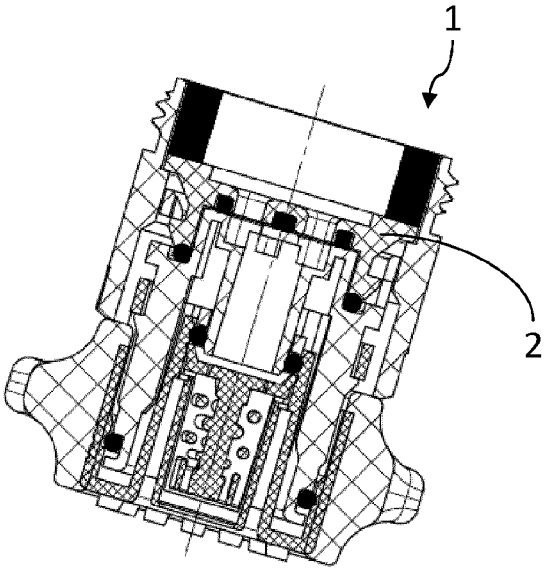
FIG. 28 shows a side view of the outlet element shown in FIGS. 23-27 cut along the cutting line denoted by XXVIII-XXVIII in FIG. 27.

FIG. 21 shows the seal receiver 10 with the sealing element 9 in a valve device 3 located in a first switching position. It can be clearly identified that the inlet openings 7 of the valve device 3 on the inflow side are arranged such that vertical projections of the inlet openings 7 onto the base element 2 are located inside the outer edge of the seal receiver 10 and the outer edge of the sealing element 9 and additionally inside a cross section of the base element 2 defined by the seal receiver 10.

The same applies when the valve device 3 is located in the second switching position, with the inlet openings 8 of the second water conduit 5 of the valve device 3 on the inflow side. This can be clearly identified by way of FIG. 22.

Figure 8:
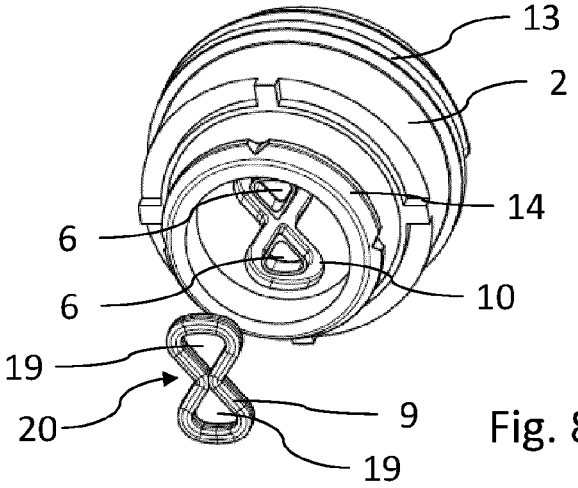
FIG. 8 shows a perspective plan view of an outflow side of the base element, wherein a seal receiver and a sealing element in the shape of an hour glass can be identified.
Figure 9:
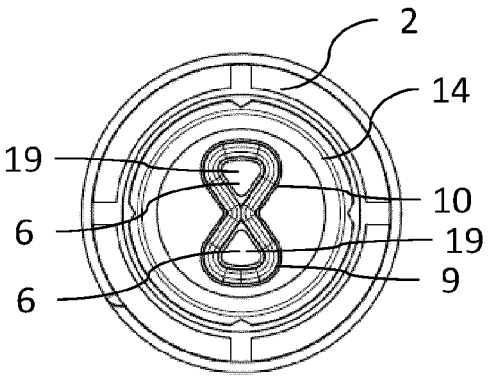
FIGS. 9 and 10 show perspective plan views of the outflow side of the base element shown in FIGS. 6-8, with the sealing element placed in the seal receiver.
Figure 10:
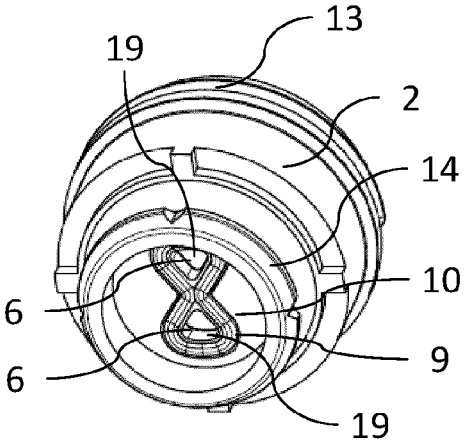
Figure 11:
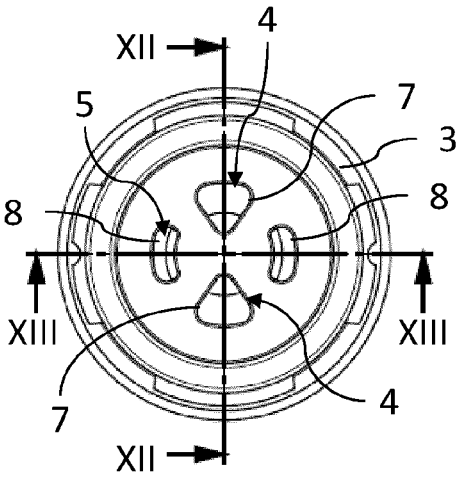
FIG. 11 shows a plan view of an inflow side of the valve device.
Figure 12:
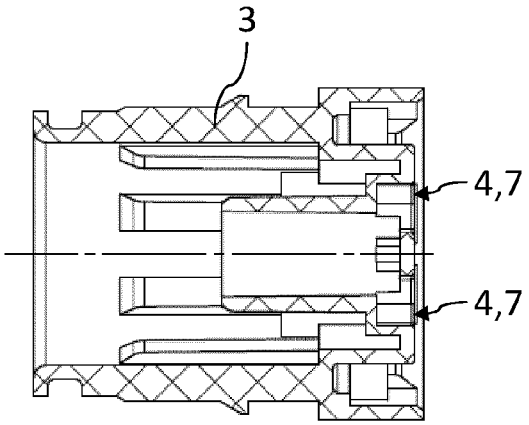
FIG. 12 shows a side view of the valve device cut along the marked cutting line denoted by XII-XII in FIG. 11.
Figure 13:
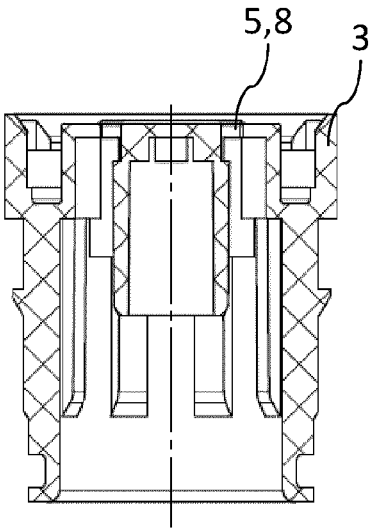
FIG. 13 shows a side view of the valve device cut along the cutting line marked by XIII-XIII in FIG. 11.
Figure 14:
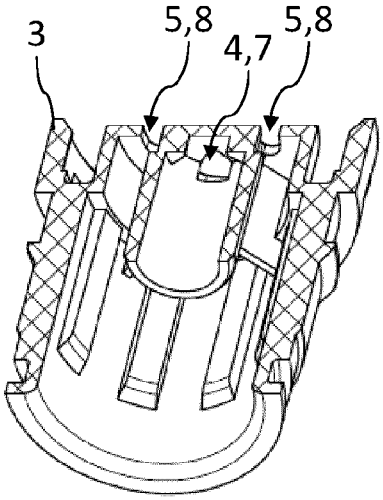
FIG. 14 shows a perspective view of the valve device cut along the cutting line denoted in FIG. 11 by XIII-XIII.
Figure 15:
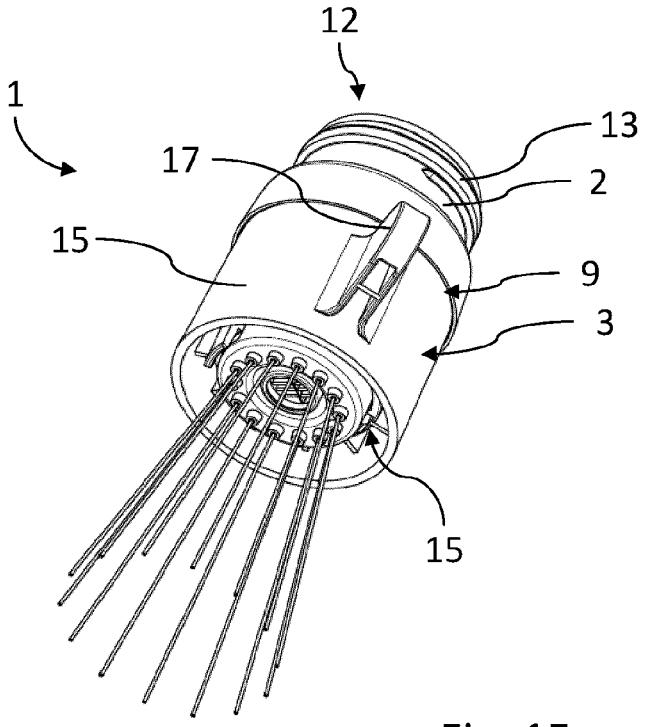
FIG. 15 shows a perspective view of the outlet element with the valve device in the spray position.
Figure 16:
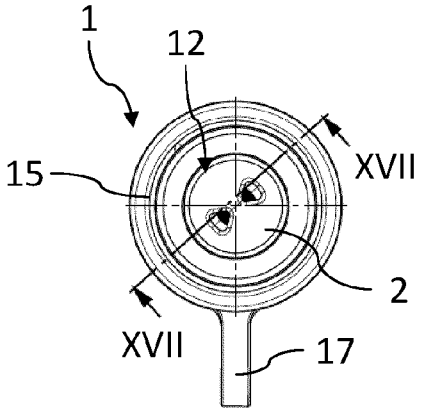
FIG. 16 shows a plan view on the inflow side of the view shown in FIG. 15.
Figure 17:
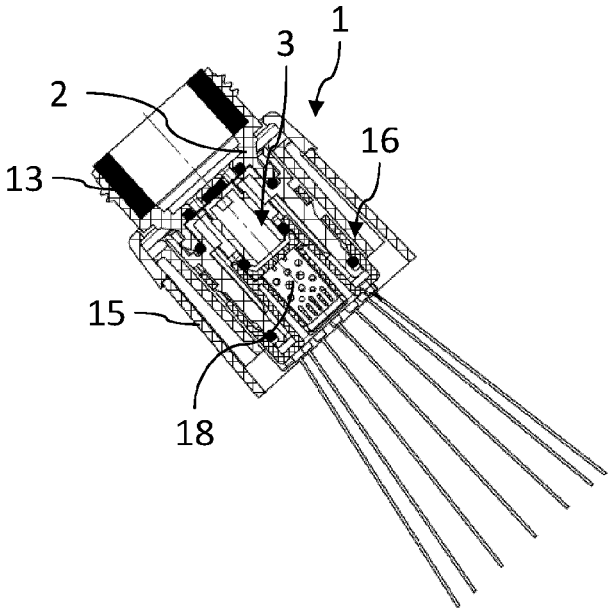
FIG. 17 shows the element shown in FIG. 16 in a side view cut along the cutting line denoted by XVII-XVII in FIG. 16.
Figure 18:
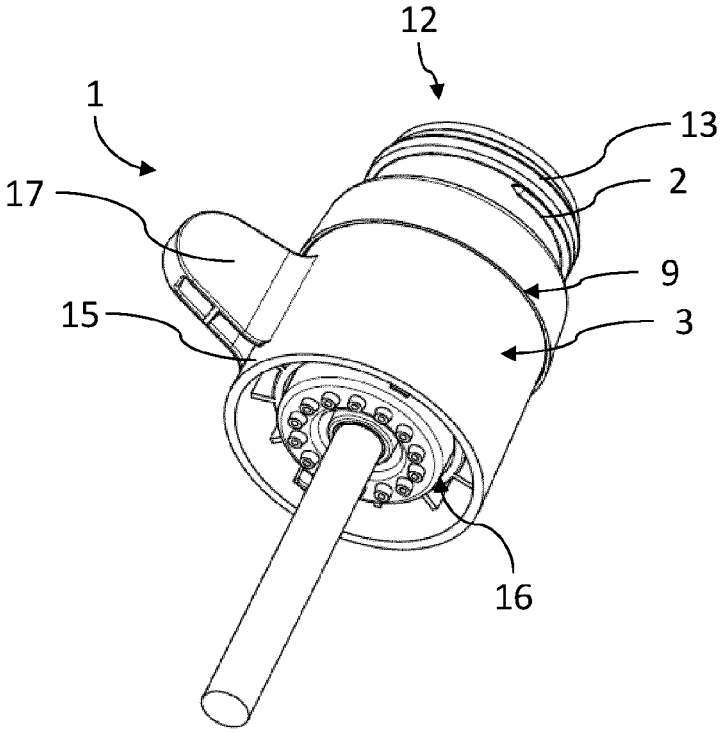
FIG. 18 shows a perspective view of the outlet element, wherein the valve device is adjusted such that the outlet element discharges a central single jet.
Figure 19:
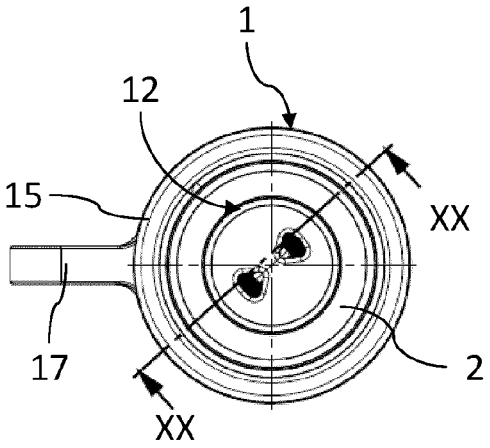
FIG. 19 shows a plan view of an inflow side of the outlet element shown in FIG. 18.
Figure 20:
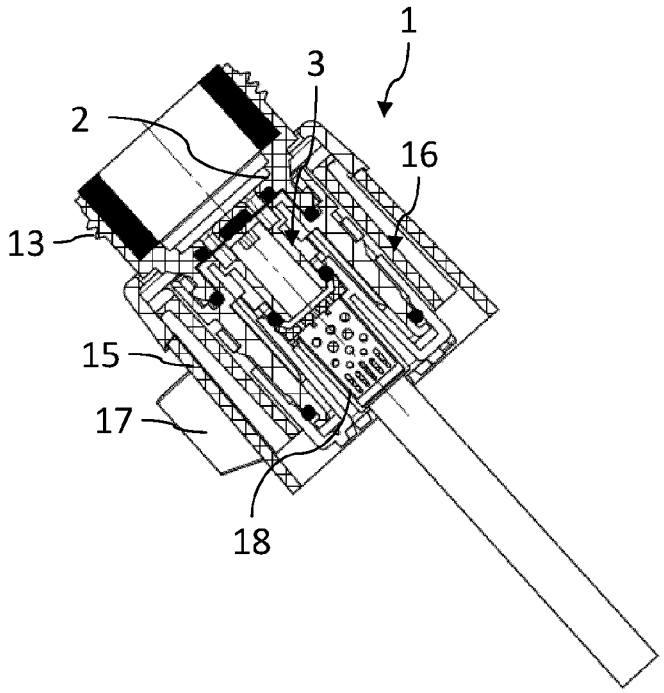

According to FIGS. 8-10 the seal receiver 10 is configured on an outflow side 11 of the base element 2. The inlet openings 7 of the water conduit 4 noticeably differ regarding their shape and size from the inlet openings 8 of the second water conduit 5 of the valve device 3.

The two outlet openings 6 of the base element 2 and at least one of the inlet openings 7 or 8 of one of the at least two water conduits 4, 5 of the valve device 3 have the same cross section or at least approximately the same cross section. According to FIGS. 21 and 22 these are the inlet openings 8 of the second water conduit on the inflow side.

When the water conduit 4, 5 is switched, projections of the inlet openings 7, 8 of the respectively switched water conduit 4, 5 on the inflow side at right-angles to the base element 2 are arranged inside the outlet openings 6. The seal receiver 10 is configured as an endless receiving groove and receives the sealing element 9 therein. The sealing element 9 can be denoted as a sealing ring in a figure of eight or as a sealing ring having an hour glass shape. The sealing element 9 is configured such that it can seal the passage between the outlet openings 6 of the base element 2 on the outflow side and the inlet openings 7 or 8 of the respectively switched water conduits 4 and 5 on the inflow side.

To this end, the sealing element 9 has a number of through-openings 19 which are separated from one another, the number corresponding to a number of outlet openings 6 of the base element 2 on the outflow side and a number of inlet openings 7 or 8 of a water conduit 4, 5 on the inflow side. In the exemplary embodiment shown, the sealing element 9 has two through-openings 19 which are separated from one another and, as already set forth above, are configured as an hour glass shape or figure of eight. The through-openings 19 of the sealing element 9 and the outlet openings 6 of the base element 2 on the outflow side respectively have corresponding geometries in pairs. The through-openings 19 are separated from one another by a constriction 20 of the sealing element 9. Thus the space outside the through-openings 19 is usable. The figures illustrate that the base element 2 on its inflow side 12 has a threaded pipe connector 13 by which it can be screwed, for example, onto an outlet piece of a sanitary fitting.

The base element 2 has on its outlet side 11 an extension 14 via which the valve device 3 is connected to the base element 2. The extension 14 is configured in an annular manner and integrally formed on the base element 2, namely on the outflow side 11. In the position of use, the valve device 3 is plugged onto the extension 14 of the base element 2.

The outlet element 1 has an actuating element 15, the valve device 3 being able to be adjusted, namely rotated, relative to the base element 2 in order to switch over between the two separate water conduits 4 and 5.

In both outlet elements 1 shown in the figures, the actuating elements 15 are configured such that valve device 3 and the extension 14 of the base element 2 are at least partially arranged inside a receiving space 16 defined by the actuating element 15. The actuating elements 15 are thus actuating sleeves which can at least partially receive therein the valve device 3 and the extension 14 of the base element 2.

The outlet elements 1 shown in FIGS. 1-22, on the one hand, and FIGS. 23-28, on the other hand, differ significantly by the shape of their actuating elements 15.

Each of the actuating elements 15 has at least one actuating wing 17. In the exemplary embodiment of the outlet element 1 shown in FIGS. 23-28, the actuating element 15 has three actuating wings 17 which are arranged so as to be distributed evenly about a longitudinal central axis of the actuating element 15, as contact surfaces for easy actuation of the valve device 3 which is connected to the actuating element 15.

The respective actuating element 15 is designed to actuate the valve device 3, which is connected thereto, such that one of the at least two separate water conduits 4, 5 is switched on and remains switched on until the user switches back to the other water conduit 4 or 5.

Figure 3:
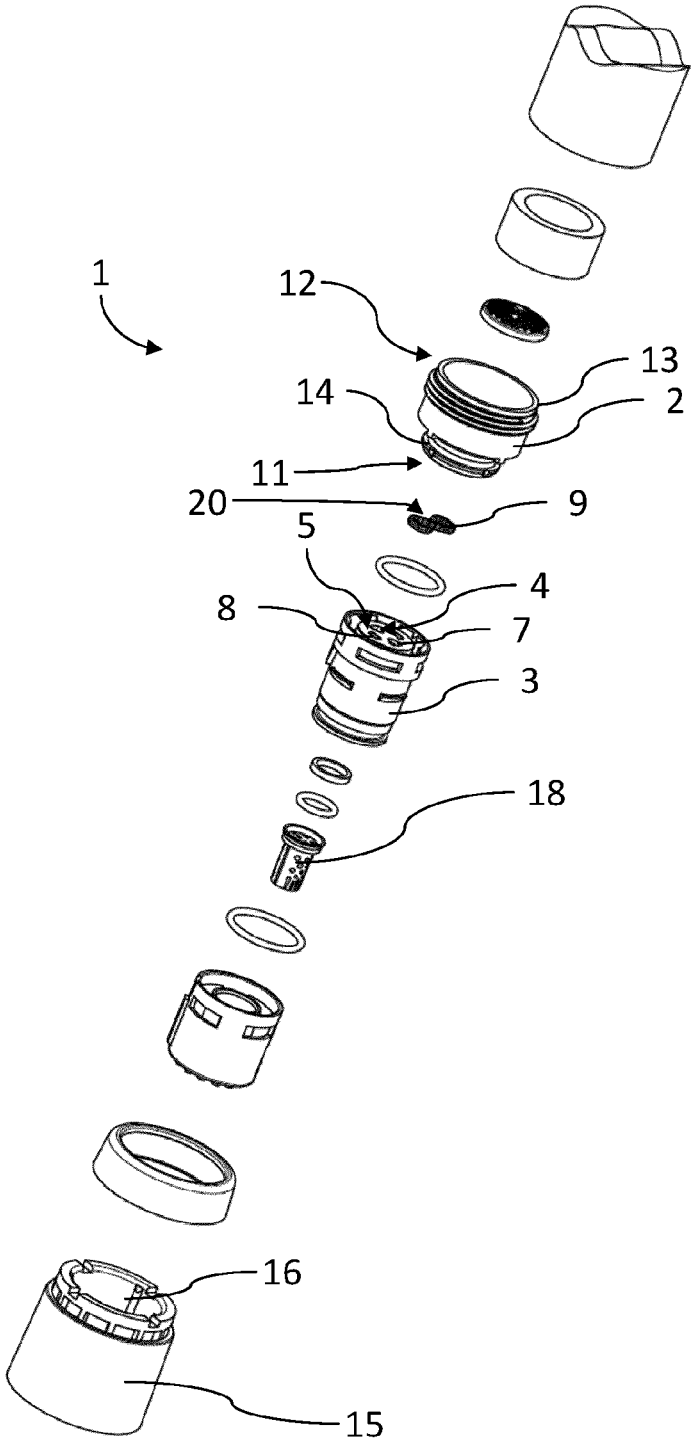
FIG. 3 shows a perspective exploded view of the outlet element shown in the two previous figures.
Figure 4:
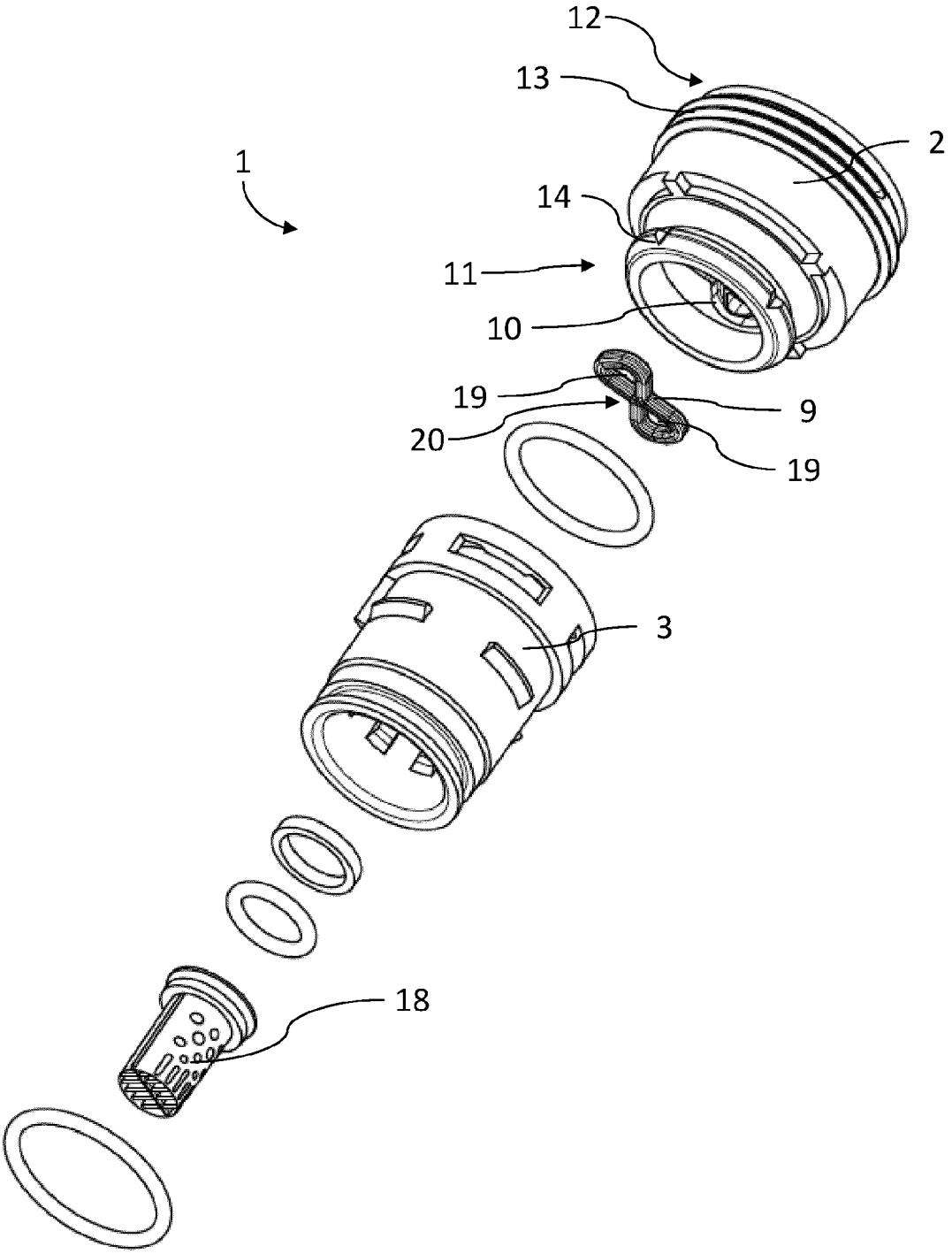
FIG. 4 shows a perspective exploded view of a base element of the outlet element with a sealing element and a valve device of the outlet element which is assigned to the base element and which can be adjusted relative to the base element between at least two switching positions for switching over between at least two separate water conduits.
Figure 5:
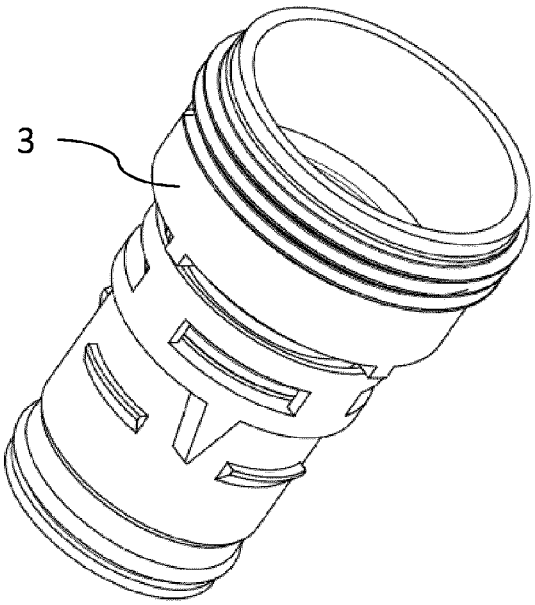
FIG. 5 shows a perspective view of the valve device shown in FIGS. 3 and 4, FIGS. 6 and 7 show plan views of an inflow side of the base element.
Figure 6:
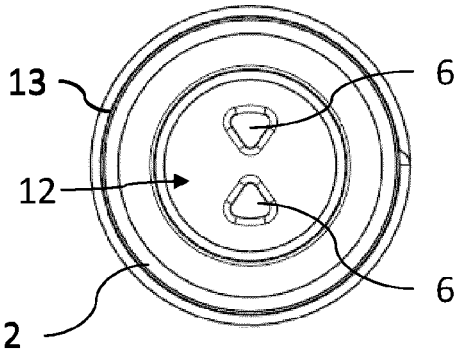
Figure 7:
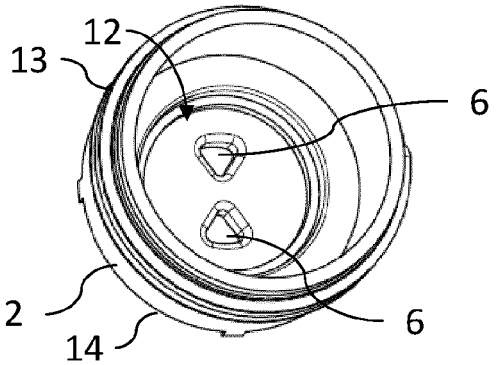

FIGS. 3 and 4 also show a jet divider 18 which is part of the valve device 3 of the outlet element 1 according to the exploded views of the outlet element 1 of FIGS. 3 and 4.

The invention relates to improvements in the field of sanitary technology. Thus an outlet element 1 is proposed for a sanitary fitting which has a base element 2 and a valve device 3 which is connected to the base element 2 and can be adjusted relative to the base element 2 between at least two switching positions for switching over between at least two separate water conduits 4, 5. In order to seal a passage between an outlet opening 6 of the base element 2 on the outflow side and at least one inlet opening 7 or 8 of a switched water conduit 4 or 5 on the inflow side, the base element 2 has a sealing element 9. This sealing element in each of the at least two switching positions is designed to seal the respective passage between an outlet opening 6 of the base element 2 on the outflow side and the at least one inlet opening 7 or 8 of the switched water conduit 4, 5 on the inlet side.

LIST OF REFERENCE SIGNS

1 Outlet element
2 Base element
3 Valve device
4 First water conduit
5 Second water conduit
6 Outlet opening at 2 on outflow side
7 Inlet opening of 4 on inflow side
8 Inlet opening of 5 on inflow side
9 Sealing element
10 Seal receiver
11 Outflow side of 2
12 Inflow side of 2
13 Threaded pipe connector
14 Extension
15 Actuating element
16 Receiving space of 15
17 Actuating wing
18 Jet divider
19 Through-opening of 9
20 Constriction

The invention claimed is:

1. An outlet element (1) for a sanitary fitting, the outlet element comprising:

a base element (2), which is configured to be connected to an outlet;

a valve device (3) which cooperates with the base element (2) and which is adjustable relative to the base element (2) between at least two switching positions for switching over between at least two separate water conduits (4, 5);

the base element (2) has at least two outlet openings (6) on an outflow side and at least two pairs of inlet openings (7, 8) of the valve device (3) on an inflow side;

a first pair of inlet openings (7) of the at least two pairs of inlet openings (7, 8) is assigned to a first water conduit (4) of the at least two separate water conduits (4, 5);

a second pair of inlet openings (8) of the at least two pairs of inlet openings (7, 8) Is assigned to a second water conduit (5) of the at least two separate water conduits (4, 5);

the base element (2) has a sealing element (9), and in each of the at least two switching positions a passage is sealable thereby between the at least two outlet openings (6) of the base element (2) on the outflow side and the at least two pairs of inlet openings (7, 8) of the at least two separate water conduits (4, 5) on the inflow side.

2. The outlet element (1) as claimed in claim 1, wherein the base element (2) has a seal receiver (10) in which the sealing element (9) is arranged.

3. The outlet element (1) as claimed in claim 1, wherein at least one of the seal receiver (10) or the sealing element (9) are at least one of arranged or configured such that, in each of the at least two switching positions, projections of the at least two pairs of inlet openings (7, 8) that extend at right-angles to the base element (2) are located at least one of a) inside an outer edge of the seal receiver (10) or inside a cross section of the base element (2) defined by the seal receiver (10).

4. The outlet element (1) as claimed in claim 2, wherein at least one of a) the seal receiver (10) is configured on an outflow side (11) of the base element (2) or b) the at least two pairs of inlet openings (7, 8) of at least two of the water conduits (4, 5) differ from one another regarding at least one of a shape or size.

5. The outlet element (1) as claimed in claim 1, wherein the at least two outlet openings (6) of the base element (2) and the at least two pairs of inlet openings (7, 8) of one of the at least two water conduits (4, 5) of the valve device (3) have a same cross section.

6. The outlet element (1) as claimed in claim 2, wherein the seal receiver (10) is endless.

7. The outlet element as claimed in claim 1, wherein the base element (2) has a threaded pipe connector (13) on an inflow side (12) thereof or the base element (2) has on an outflow side (11) thereof an extension (14) via which the valve device (3) is connectable or is connected to the base element (2).

8. The outlet element (1) as claimed in claim 7, wherein at least one of a) the extension (14) is integrally formed in an annular manner, b) the extension (14) is integrally formed on the base element (2), or c) the valve device (3) is plugged onto the extension (14).

9. The outlet element (1) as claimed in claim 1, wherein the outlet element (1) has an actuating element (15), the valve device (3) adjustable thereby relative to the base element (2) in order to switch over between the at least two separate water conduits (4, 5).

10. The outlet element (1) as claimed in claim 9, wherein at least one of the valve device (3) or at least one part of the base element (2) are arranged at least partially inside a receiving space (16) defined by the actuating element (15).

11. The outlet element (1) as claimed in claim 9, wherein the actuating element (15) is configured to actuate the valve device (3) such that one of the at least two separate water conduits (4, 5) is switched on and remains switched on until a user switches back to the other water conduit (4, 5).

12. The outlet element (1) as claimed in claim 1, wherein each said water conduit (4, 5) has a corresponding number of the at least two pairs of inlet openings (7, 8) on the inflow side.

13. The outlet element (1) as claimed in claim 1, wherein projections of the at least two pairs of inlet openings (7, 8) of the respectively switched water conduit (4, 5) on the inflow side at right-angles to the base element (2) are located inside the at least two outlet openings (6).

14. The outlet element (1) as claimed in claim 1, wherein the sealing element (9) has a first number of through-openings (19) which are separated from one another, the first number corresponding to a second number of the at least two outlet openings (6) of the base element (2) on the outflow side.

15. The outlet element (1) as claimed in claim 14, wherein the through-openings (19) and the at least two outlet openings (6) on the outflow side have corresponding geometries.

16. The outlet element (1) as claimed in claim 14, wherein there are two of the through-openings (19) which are separated from one another by a constriction (20).

17. The outlet element (1) as claimed in claim 1, wherein the sealing element (9) is configured with an hour glass or figure eight shape.

* * * * *